US007942491B2

(12) United States Patent
Fukasawa et al.

(10) Patent No.: US 7,942,491 B2
(45) Date of Patent: May 17, 2011

(54) SERIAL RECORDING APPARATUS AND METHOD OF FEEDING RECORDING MEDIUM

(75) Inventors: Jun Fukasawa, Hata-machi (JP); Yoshiyuki Kimoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 429 days.

(21) Appl. No.: 12/231,416

(22) Filed: Sep. 2, 2008

(65) Prior Publication Data

US 2009/0057981 A1 Mar. 5, 2009

(30) Foreign Application Priority Data

Aug. 31, 2007 (JP) ..... 2007-226713

(51) Int. Cl.
*B41J 29/38* (2006.01)
*B41J 2/165* (2006.01)
*B41J 2/01* (2006.01)

(52) U.S. Cl. ..... 347/16; 347/32; 347/104

(58) Field of Classification Search ..... 347/32, 347/16, 104
See application file for complete search history.

(56) References Cited

U.S. PATENT DOCUMENTS 6,076,911 A 6/2000 Watanabe
6,665,089 B1 * 12/2003 Austin et al. ..... 358/1.18
2006/0268089 A1 * 11/2006 Takeuchi ..... 347/104

FOREIGN PATENT DOCUMENTS

| | | |
|---|---|---|
| JP | 07-214859 A | 8/1995 |
| JP | 2001-191601 A | 7/2001 |
| JP | 2001-232882 | 8/2001 |
| JP | 2003-072095 A | 3/2003 |
| JP | 2006-212923 | 8/2006 |
| JP | 2007-090761 | 4/2007 |

* cited by examiner

*Primary Examiner* — Julian D Huffman

(57) ABSTRACT

Provided is a serial recording apparatus including: a feed unit which feeds a recording medium; a recording unit which performs recording with respect to the fed recording medium; a movement unit which moves the recording unit in order to performing recording; a transporting unit which transports the recording medium in a direction crossing the movement direction of the recording unit; a controller which controls the recording unit, the movement unit, the transporting unit and the feed unit; and a determination unit which determines whether a target stop position of the recording unit satisfies a target position condition, during the movement of the recording unit, wherein the controller starts a feed operation of the subsequent medium using the feed unit at a timing before the movement of the recording unit is stopped, if the target stop position satisfies the target position condition.

5 Claims, 7 Drawing Sheets

SERIAL RECORDING APPARATUS AND METHOD OF FEEDING RECORDING MEDIUM

BACKGROUND

1. Technical Field

The present invention relates to a serial recording apparatus such as a serial printer including an automatic sheet feeder, and more particularly, a serial recording apparatus for controlling the feed of a subsequent recording medium after the recording a previous recording medium is completed, and a method of feeding a recording medium.

2. Related Art

In a recording apparatus such as a printer, an automatic sheet feeder for automatically feeding paper which is subjected to a recording operation is included. In the automatic sheet feeder, if the printing of previous paper is completed, the feed of subsequent paper is started at a timing after the previous paper is ejected or slightly before the ejection of the previous paper is completed.

However, in a serial recording apparatus, the printing of the paper is performed by alternately performing a printing operation for performing the recording of one row (1 raster line) by moving a recording head provided in a carriage once in a main scan direction while ejecting ink droplets onto the paper and a transporting operation for transporting the paper by a predetermined pitch in a sub scan direction (for example, see JP-A-2001-232882 and JP-A-2006-212923)

For example, in the serial recording apparatuses disclosed in JP-A-2001-232882 and JP-A-2006-212923, in order to shorten a printing time, an overlap control operation for performing a paper transporting operation and a carriage operation at a partially overlapped timing is performed (for example, see JP-A-2001-232882 and JP-A-2006-212923). In the overlap control operation, first, if a printing operation of one pass is completed, a paper feed motor (PF motor) is operated so as to transport the paper. Thereafter, before the driving of the PF motor is completed, a carriage motor (CR motor) is operated at a predetermined timing so as to start the movement of the carriage. Accordingly, the carriage is accelerated while the paper is transported such that a printing operation which is performed at a constant speed range is started substantially simultaneous with the completion of the paper transportation. Therefore, it is possible to shorten the printing time compared with the case where the CR motor is started after the completion of the paper transportation.

A serial recording apparatus including a power delivering switching device which shares one power source (electric motor) between an automatic sheet feeder and a suction pump of a maintenance device for a recording head and switches a power destination according to the movement position of a carriage is known (for example, see JP-A-2007-90761 (paragraphs 0078 to 0080)).

In an ink jet recording apparatus, in order to prevent nozzles of a recording head from being clogged, a flushing operation for periodically ejecting a thickened ink in nozzles and refreshing the ink in the nozzles is performed. When the flushing operation is performed, the ink droplets are ejected into a cap of the maintenance device for performing the maintenance of the recording head. If the waste ink collected in the cap by the flushing operation remains, the pipe of the cap may be clogged. If the amount of waste ink ejected into the cap exceeds a predetermined amount, a suction pump communicating with the cap is driven and an air suction operation for sucking and removing the waste ink collected in the cap is performed (for example, see JP-A-2007-90761 (paragraphs 0078 to 0080))

Although the overlap control operation for performing the paper transporting operation and the carriage operation at the partially overlapped timing is performed, a printing speed of the serial recording apparatus is lower than that of a line printer or a page printer. More particularly, there is a need for increasing a printing speed at the time of a high-speed printing operation.

SUMMARY

An advantage of some aspects of the invention is that it provides a serial recording apparatus which is capable of starting the feed of a subsequent medium after the recording of a final row is completed and before a recording unit is stopped, and a method of feeding a recording medium.

According to an aspect of the invention, there is provided a serial recording apparatus including: a feed unit which feeds a recording medium; a recording unit which performs recording with respect to the fed recording medium; a movement unit which moves the recording unit in order to performing recording; a transporting unit which transports the recording medium in a direction crossing the movement direction of the recording unit; a controller which controls the recording unit, the movement unit, the transporting unit and the feed unit; and a determination unit which determines whether a target stop position of the recording unit satisfies a target position condition that a subsequent recording medium can be fed, during the movement of the recording unit, wherein the controller starts a feed operation of the subsequent medium using the feed unit at a timing before the movement of the recording unit is stopped, if the target stop position satisfies the target position condition.

According to this configuration, if the target stop position of the recording unit is in feedable region, before the movement of the recording unit is stopped, the feed operation of the subsequent medium using the feed unit is started. Accordingly, since the feed can be started immediately after the recording of the preceding recording medium is completed, without waiting for the moved recording unit to be stopped, it is possible to improve recording throughput.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
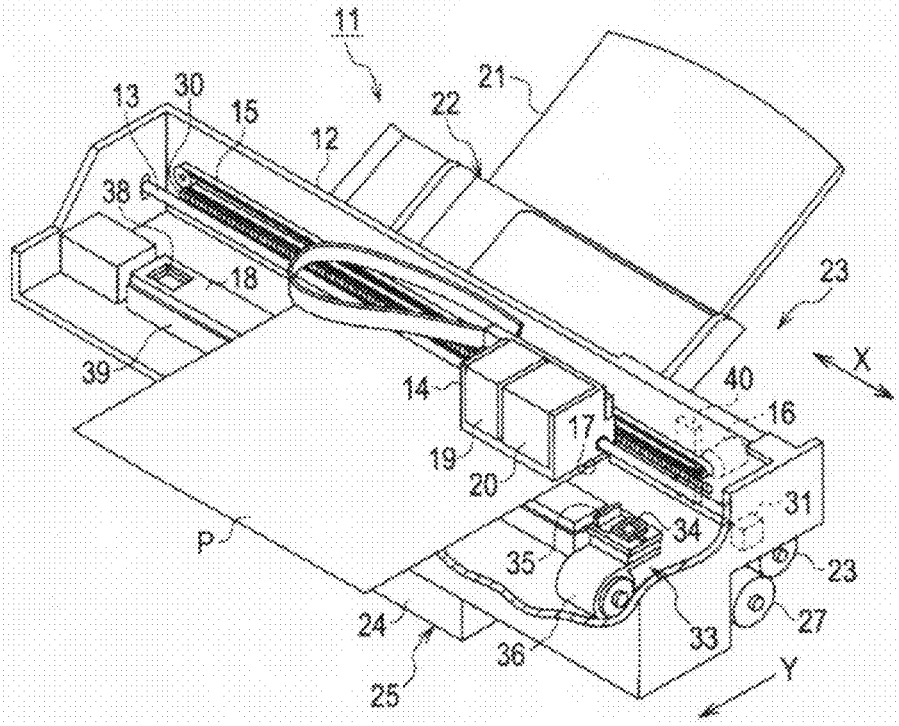
FIG. 1 is a perspective view showing the schematic configuration of a printer according to a first embodiment of the invention.

Hereinafter, a first embodiment of the invention will be described with reference to FIGS. 1 to 10. FIG. 1 is a perspective view showing the basic configuration of a recording apparatus.

As shown in FIG. 1, an ink jet printer (hereinafter, referred to as a printer 11) which is a serial recording apparatus includes a main frame 12 having an elongated rectangular box shape and having a bottom. A guide shaft 13 having a predetermined length is mounted between the right and left sidewalls of the main frame 12 in the same drawing. A carriage 14 is fitted in the guide shaft 13 so as to be moved in an axial direction of the guide shaft 13. An endless timing belt 15 which is rotatably supported on the inner back surface of the main frame 12 in a state of extending in a main scan direction X is fixed to a position of the back surface side of the carriage 14. The carriage 14 is connected to a driving shaft of a carriage motor (hereinafter, referred to as a CR motor 16) via the timing belt 15 such that power is delivered. When the CR motor 16 is driven, the timing belt 15 is rotated and the carriage 14 is reciprocally moved in the main scan direction X by the rotation of the timing belt 15.

An ink jet recording head 17 is provided below the carriage 14 and a lower surface of the recording head 17 is a nozzle forming surface 17*a* (see FIG. 2) in which a plurality of nozzles for ejecting an ink as liquid are formed. At a position opposite to the recording head 17 of the main frame 12, a platen 18 for defining a gap between the nozzle forming surface 17*a* of the recording head 17 and paper P is provided. A black ink cartridge 19 for supplying the ink to the recording head 17 and color ink cartridges 20 in which inks of three colors of cyan, magenta and yellow are respectively received are detachably mounted on the carriage 14. The inks are supplied from the ink cartridges 19 and 20 to the recording head 17. The recording head 17 to which the inks are supplied from the ink cartridges 19 and 20 ejects (discharges) the inks through the nozzles of the nozzle forming surface 17*a*.

On the back surface of the printer 11, a feed tray 21 for loading a plurality of sheets of paper P and a rear feeder 22 which is an automatic sheet feeder (ASF) for separating and feeding only uppermost one of the plurality of sheets of paper P loaded in the feed tray 21 to the downstream side of the sub scan direction Y are provided. The rear feeder 22 includes a feed motor (hereinafter, referred to as an ASF motor 23). The rear feeder 22 includes a feed roller 22A (see FIG. 2) and feeds uppermost one of the sheets of paper loaded in the feed tray 21 by rotation of the feed roller 22A by the ASF motor 23. A front feeder 25 including a feed cassette 24 is provided on the front lower side of the printer 11. In the front feeder 25, a pickup roller (not shown) which is brought into contact with uppermost one of the sheets of paper received in the feed cassette 24 is rotated by driving the ASF motor 23 such that the uppermost paper is transported, is reversed by a reverse guide plate (not shown) is reversed, and is supplied to a paper transporting path shared by the rear feeder 22.

On the right lower side of the main frame 12 of FIG. 1, a paper feed motor (hereinafter, referred to as a PF motor 27) is provided. A paper transporting roller 28 and an ejection roller 29 (both see FIG. 2) which are provided on the sheet transporting path with the recording head 17 interposed therebetween are rotated by driving the PF motor 27 such that the paper P is transported in a sub scan direction Y. Then, the paper P is recorded (printed) by alternately performing a printing operation for ejecting the ink from the nozzle forming surface 17*a* of the recording head 17 onto the paper P while the carriage 14 is reciprocally moved in the main scan direction X and a paper transporting operation for transporting the paper P in the sub scan direction Y by a predetermined transportation amount.

In the main frame 12, a linear encoder 30 is provided along the guide shaft 13. The linear encoder 30 outputs pulses of the number proportional to the movement distance of the carriage 14 and the printer 11 performs the speed control and the position control of the carriage 14 on the basis of the movement position, the movement speed and the movement direction of the carriage 14 obtained by detecting the output pulses.

In the printer 11 according to the present embodiment, an automatic platen gap adjustment device (also called an APG device 31) for adjusting the gap between the recording head 17 and the platen 18 by vertically moving the carriage 14 is mounted. The APG device 31 is driven by the ASF motor 23. The driving of the ASF motor 23 is controlled such that an adequate platen gap according to the thickness of the paper specified from the information on the type of the paper acquired from a host computer by the printer 11 is ensured, and thus the gap (paper gap) between the recording head 17 and the paper P becomes a predetermined value. The APG device 31 according to the present embodiment adjusts the height position of the guide shaft 13 via a cam mechanism (not shown) by driving the ASF motor 23 so as to adjust the height of the carriage 14.

The right end of the carriage 14 on the movement path in FIG. 1 is a home position where the carriage 14 is positioned at a standby state in which the recording is not performed and a maintenance device 33 for cleaning the recording head 17 is positioned just under the carriage 14 positioned at the home position. The maintenance device 33 includes an approximately rectangular cap 34 which functions as a cover for preventing the ink in the nozzles of the recording head 17 are from being thickened, a wiper 35 for wiping the nozzle forming surface 17*a* (see FIG. 2), and a suction pump 36 which is driven so as to apply negative pressure to the cap 34.

In a state in which the carriage 14 is moved to the home position and the recording head 17 is positioned just above the cap 34, the ASF motor 23 is driven and the carriage 14 is moved downward to a lowermost position such that the nozzle forming surface 17*a* of the recording head 17 is closely adhered to the cap 34 so as to seal the nozzles.

The cap 34 has a liquid suction function for capping the nozzle forming surface 17*a* of the recording head 17, applying the negative pressure from the suction pump 36 to the sealed space, and forcedly discharging the ink from the recording head 17, in addition to the cover function (capping function) for preventing the ink of the nozzles from being dried. The cap 34 is provided so as to be moved upward or downward between a lower position where the carriage 14 does not interfere with the recording head 17 when being positioned at the home position and a capping position where the cap is in contact with the nozzle forming surface 17*a* of the recording head 17 so as to surround the nozzles. The elevation mechanism of the cap 34 may employ, for example, a mechanical elevation mechanism for moving a slider for mounting the cap upward against the energization of a spring by pressing a lever by the carriage 14 just before the carriage 14 reaches the home position and moving the cap 34 downward by the energization force of the spring when the carriage 14 retreats from the home position or an electric motor-driven type elevation mechanism which is moved upward or downward by a motor. The electric motor-driven type elevation mechanism may use, for example, the power of the PF motor 27.

The suction pump 36 is rotated by the ASF motor 23. Although the suction pump 36 is, for example, constituted by a tube pump, a gear pump, a gear pump, a bellows pump or a diaphragm pump may be employed.

The wiper 35 is positioned adjacent a printing region side of the cap 34, and, while the carriage 14 is moved from the home position to the printing region side after the suction operation of the recording head 17 is completed, the nozzle forming surface 17*a* is slidably brought into contact with the wiper 35 so as to wipe the nozzle forming surface 17*a*.

In the upper surface of the end (the left end of FIG. 1) of the platen 18 opposite to the home position, a flushing through-hole 38 for ejecting ink droplets through the nozzles of the recording head 17, which is not associated with printing, is formed. In the present example, the flushing operation is performed by ejecting the ink droplets into the through-hole 38 or the cap 34 at a predetermined time during printing. A rectangular box-shaped waste liquid tank 39 which extends in the main scan direction X is provided below the platen 18, and an ink absorber constituted by a porous member is received thereon. The waste ink sucked from the nozzles via the cap 34 at the time of cleaning or the ink droplets ejected into the through-hole 38 or the cap 34 at the time of flushing are collected into the waste liquid tank 39.

The printer 11 includes a switch holding device 40 for operating the carriage 14 to be engaged just before the home position. As described above, the switch of the destination of the power of ASF motor 23 to the rear feeder 22, the front feeder 25, the APG device 31 and the suction pump 36 of the maintenance device 33, all of which use the ASF motor 23 as the common power source, is performed by the switch holding device 40.

Figure 3:
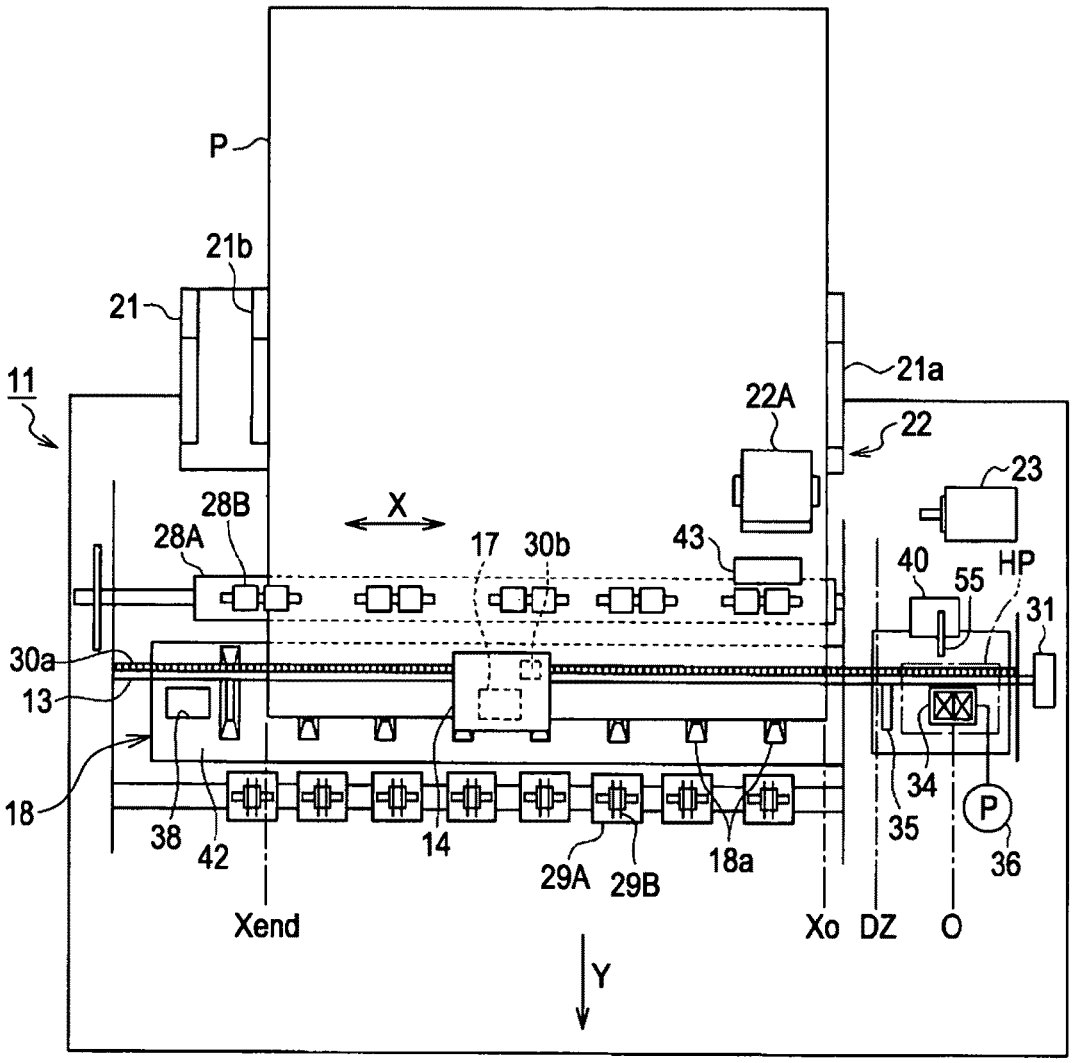
FIG. 3 is a plan view of the printer.
Figure 3:
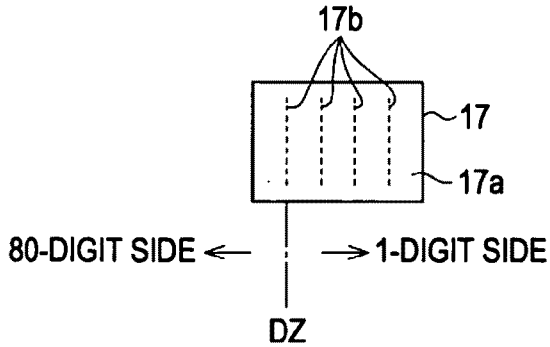

FIG. 3 is a plan view of main portions of the printer. In FIG. 3, the position denoted by a dashed dotted line in which the carriage 14 is moved to the right end of the same drawing and the recording head 17 and the cap 34 are matched with each other in a vertical direction (a vertical direction of the same drawing) is the home position HP of the carriage 14.

The linear encoder 30 includes a tape-shaped sign plate 30*a* in which a plurality of slits are formed at a predetermined pitch (for example, 1/180 inches (=1/180×2.54 cm) and a sensor 30*b* including a light emission element and a light reception element provided in the carriage 14. The light reception element receives the light emitted from the light emission element and passing through the slits when the carriage 14 is moved and the sensor 30*b* outputs detection pulses. A controller 60 shown in FIG. 6 counts the edges of the detection pulses (two pulses (in which an A-phase and a B-phase are shifted by 90 degrees) received from the linear encoder 30 and obtains the position of the carriage 14 using the home position HP as an original position. Accordingly, the position of the main scan direction X of the printer 11 can be managed by the count value of a CR counter 83 see FIG. 6) of the controller 60 for managing the position of the carriage 14. In the present embodiment, in the movement position of the carriage 14, the side of the home position HP is called a "1-digit side" and the side opposite to the home position is called an "80-digit side".

As shown in FIG. 3, a DZ position is set between the home position O which is the original position of the movement position of the carriage 14 and a left end position of a print target region Xo to Xend, as a switch position. A total region obtained by adding an acceleration region or a deceleration region necessary when the carriage 14 reaches a target speed at the time of printing to the both sides of the print target region Xo to Xend becomes a maximum range in which the carriage 14 can be moved during printing. The DZ position corresponds to a limitation position of the home position side (1-digit side) in a "printing region".

As shown in the right lower side of FIG. 3, a plurality (for example, four) of nozzle arrays 17*b* are arranged in the nozzle forming surface 17*a* of the recording head 17 in a paper transporting direction Y. The nozzle arrays 17*b* are constituted by 180 nozzle groups which are arranged in a zigzag in the Y direction. When a nozzle array 17*b* of the plurality of nozzle arrays 17*b* of the recording head 17 positioned at the 80-digit side is matched with the DZ position, the carriage 14 is positioned at the DZ position. The switch holding device 40 includes a lever type power switching member 55 which is engaged and pressed in the movement process just before the carriage 14 reaches the home position, and the switch holding device 40 is switched by operating the power switching member 55 of the switch holding device 40 while the carriage 14 is moved to the 1-digit side between the DZ position and the home position HP. When the carriage 14 is positioned at the DZ position or over (the range of the 80-digit side including the DZ position) (that is, is positioned in the printing region (feed region), the switch holding device 40 is positioned at a first switch position for selecting the rear feeder 22 and the front feeder 25 as the power destination of the ASF motor 23. In contrast, when the carriage 14 is positioned at the home position, the switch holding device 40 is positioned at a second switch position for selecting the APG device 31 and the suction pump 36 as the power destination of the ASF motor 23.

The feed tray 21 includes a fixed guide 21*a* which extends to the end of the home position HP and a movable guide 21*b* which is slidably provided in the width direction (the main scan direction X) according to the width of the paper P. The position of the paper P in the width direction (the X direction) during printing is defined by the two guides 21*a* and 21*b* and the end of the paper at the side of the home position HP (the 1-digit side) is defined at the position of the inner side surface of the fixed guide 21*a*. The position of the end of the paper of the 1-digit side is always constant regardless of the size of the paper P because the fixed guide 21*a* is fixed to the printer 11, and is expressed by the position Xo separated from the home position HP (original position O) by the predetermined distance when being expressed by the count value of the CR counter 83. If the width of the paper P (in the X direction) expressed by the count value of the CR counter 83 is Pwidth, the position of the end of the paper opposite to the home position (the 80-digit side) is expressed by a value Xend (=Xo+Pwidth).

The platen 18 has a plurality of ribs 18*a* which protrude at a predetermined interval in the main scan direction X, and the surface of the ink absorber 42 is exposed in the upper surface of the platen in a region excluding the ribs 18*a*. Since the paper P slides on the ribs 18*a*, the back surface of the paper P is not contaminated by the ink absorber 42.

The rear feeder 22 includes the feed roller 22A, and the feed roller 22A is rotated on the basis of the driving force of the ASF motor 23 delivered via the switch holding device 40 and feeds only uppermost one of sheets of paper P set in the feed tray 21. A paper detection sensor 43 is provided at the upstream position of the recording head 17 on the feed path of the paper P such that the front end of the fed paper P is detected by the paper detection sensor 43.

In the printer 11, the paper transporting roller 28 which transports the paper P in the sub scan direction Y includes a transportation driving roller 28A and a transportation driven roller 28B. Meanwhile, an ejection roller 29 which ejects the paper P after printing includes an ejection driving roller 29A and an ejection driven roller 29B. The transportation driving roller 28A and the ejection driving roller 29A are rotated by the driving force of the PF motor 28 (see FIG. 1) such that the paper P after recording is transported and ejected in the sub scan direction Y. In the present embodiment, a transportation unit is constituted by the PF motor 27, the transportation driving roller 28A, the transportation driven roller 28B, the ejection driving roller 29A and the ejection driven roller 29B.

Figure 2:
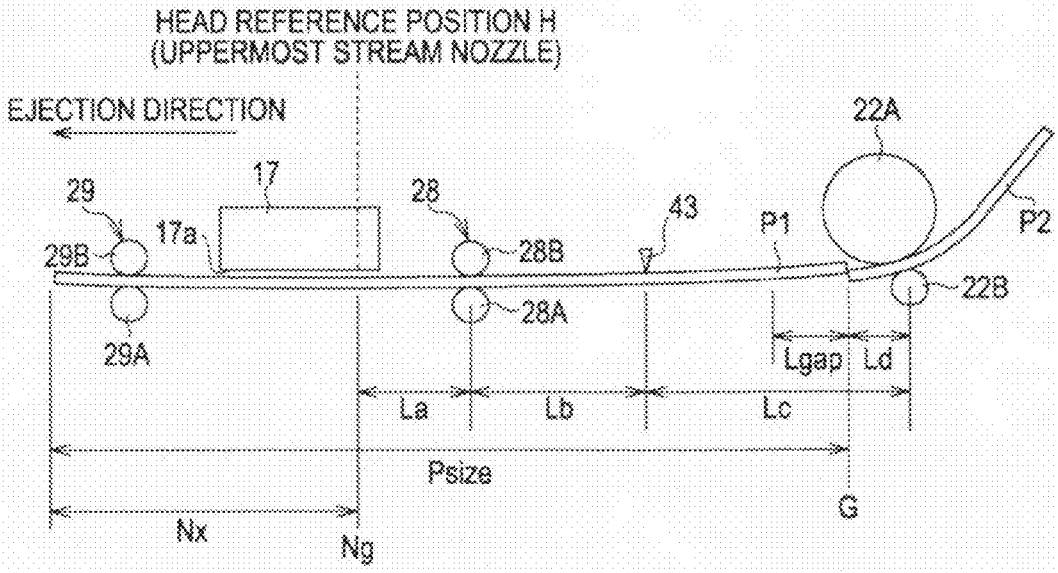
FIG. 2 is a side view showing a transporting system.

FIG. 2 is a view showing the feeder (ASF) and the transporting device (PF) when viewed from the side. Since the ASF motor 23 and the PF motor 27 are separately provided, subsequent paper P2 can be fed while previous paper P1 is transported. In addition, the interval between the paper P1 and the paper P2 narrows such that the printing of the subsequent paper P2 can be started after the printing of the paper P1 is completed.

The paper detection sensor 43 is provided between the feed roller 22A and the paper transporting roller 28. When the front end of the fed paper P1 passes through the paper transporting roller 28 and the paper P1 is transported to the position corresponding to a head reference position H which is the position of the nozzles (the upstream nozzles) positioned at the upstream side in the transportation direction, the counter for managing the transportation position is reset. In FIG. 3, the position of the upstream nozzles of the recording head 17 is the head reference position H. A distance between the head reference position H (the upstream nozzles) and the nip pint of the paper transporting roller is La, a distance between the nip point of the paper transporting roller and the paper detection sensor 43 is Lb, and a distance between the paper detection sensor 43 and the nip point of the feed roller (between the feed roller 22A and the nip point of a retard roller 22*b*) is Lc.

Accordingly, a distance Nx between the front end of the paper and the position corresponding to the head reference position H is obtained by the counter. When the count value is a value Psize−La−Lb−Lc+Ld obtained by subtracting La+Lb+Lc−Ld from the paper size Psize, the driving of the ASF motor 23 pauses and then the value of the counter is increased by Lgap and, when the count value is a value Psize−La−Lb−Lc+Ld+Lgap, the ASF motor 23 is driven again and then the transportation of the paper P1 and the feed of the paper P2 are simultaneously performed in a state in which the gap Lgap is ensured.

In the present embodiment, since the position of the paper P1 is managed at the position of the paper opposite to the head reference position H, when the position of the downstream side in the transportation direction separated from the rear end of the paper P1 by the distance La+Lb+Lc−Ld reaches the head reference position H, it is determined that the paper reaches an inter-page control position Ng where the rear end of the paper is positioned at an inter-page control position G. Here, Nx denotes the sheet transportation amount of the paper P1 from the position where the front end of the paper P1 reaches the head reference position H.

In the present embodiment, the transportation distance (the paper transportation amount) of the paper from when the front end of the paper P1 reaches the head reference position H is counted by the PF counter 84 (see FIG. 6) and the position of the paper P1 is managed by the count value. When the paper transportation amount Nx which is the count value of the PF counter 84 is the value Ng which is Psize−(La+Lb+Lc−Ld), it is determined that the paper P1 reaches the inter-page control position Ng.

A heading position is decided according to a layout condition for deciding a print start position of the paper, such as margin (top margin) or marginless printing, and the printing is started if the value of the counter reaches the heading position.

In the present embodiment, the transportation of the paper until the head of the fed paper appears is defined as a "fed operation", the transportation of the paper until the printing of the paper is completed is defined as a "paper transportation operation", and the transportation of the paper until the rear end of the printed paper is not detected by the paper detection sensor 43 is defined as an "ejection operation". In addition, if the paper is transported to the position where the rear end of the paper is not detected by the paper detection sensor 43 when the printing is completed, the ejection operation of the paper is not performed, the feed operation of the subsequent paper P2 is performed, and the ejection roller 29 is rotated by the feed operation such that the previous paper P1 is ejected.

The predetermined gap between the paper P1 and the paper P2 is ensured, the paper detection sensor 43 is turned off by the gap, and the front end of the subsequent paper P2 is detected, such that the subsequent paper P2 can be detected by the paper detection sensor 43. Accordingly, the head of the subsequent paper P2 is transported from the position detected by the paper detection sensor 43 by a predetermined distance.

Figure 4:
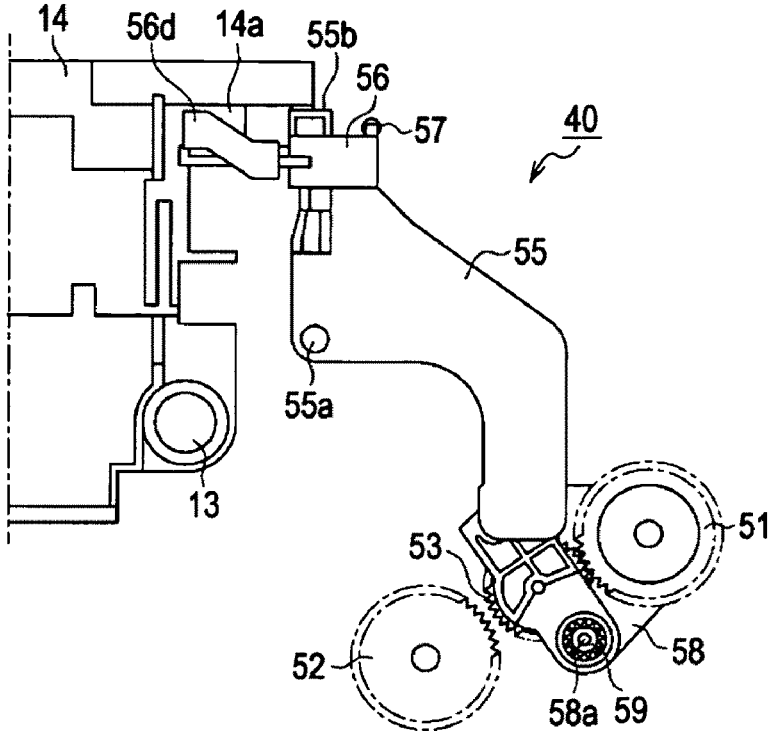
FIG. 4 is a side view of a switch holding device.
Figure 5:
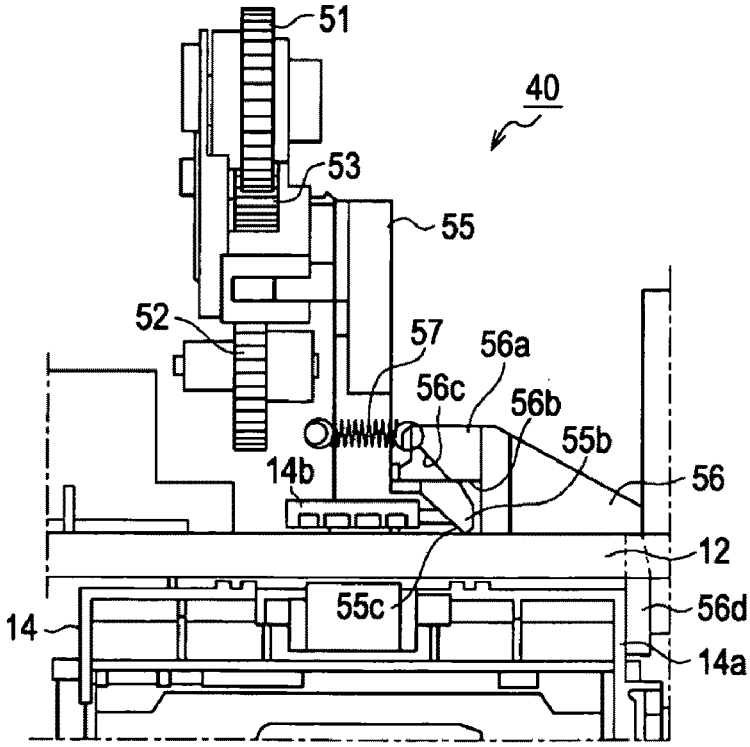
FIG. 5 is a plan view of the switch holding device.

FIG. 4 is a side view showing the switch holding device 40 when viewed from the main scan direction and FIG. 5 is a plan view of the switch holding device 40. As shown in FIG. 4, the switch holding device 40 includes a first transmission gear 51 for transmitting the power to the rear feeder 22 and the front feeder 25 and a second transmission gear 52 which is separated from the first transmission gear 51 by a predetermined distance in a direction perpendicular the main scan direction and transmits the power to the maintenance device 33 and the APG device 31. In a state in which a power transmission gear 53 driven by the ASF motor 23 is engaged with the first transmission gear 51, by switching the forward/backward rotation of the first transmission gear 51, it can be determined whether the rear feeder 22 or the front feeder 25 is driven by a planetary gear mechanism (not shown). Similarly, in a state in which the power transmission gear 53 is engaged with the second transmission gear 52, by switching the forward/backward rotation of the second transmission gear 52, it can be determined whether the maintenance device 33 (the suction pump 36) or the APG device 31 is driven by a planetary gear mechanism (not shown).

The switch holding device 40 is pushed to the carriage 14 and is switched. When the carriage 14 is positioned in the printing region (including the DZ position) and is in a non-engagement state with a power switching member 55, the power transmission gear 53 is positioned at a first engagement position where the power transmission gear is engaged with the first transmission gear 51 and, when the carriage 14 is positioned at the 1-digit side rather than the DZ position and is engaged with the switch holding device 40, the power transmission gear 53 is positioned at a second engagement position where the power transmission gear 53 is engaged with the second transmission gear 52. The switch holding device 40 includes the power switch member 55 shown in FIGS. 4 and 5, a first restraining member 56, the main frame 12, a coil spring 57 (shown in FIG. 5), and a lever member 58 shown in FIG. 4.

The power switching member 55 is provided centering around a pivot shaft 55*a* parallel to the main scan direction, a restrained portion 55*b* is integrally formed in the upper end thereof, and the lower end thereof is connected to the lever member 58.

The first restraining member 56 is slidably provided in the main scan direction and is energized to the 80-digit side (the left direction of FIG. 5) by the coil spring 57. The first restraining member 56 includes a restraining portion 56*a* which can be engaged with the restrained portion 55*b* and a first engaged portion 56*d* which can be engaged with a first carriage engagement portion 14*a* of the side surface of the carriage 14, which are integrally formed.

The lever member 58 is provided centering around a pivot shaft 58*a* parallel to the main scan direction and the power transmission gear 53 which is rotated about a rotation shaft parallel to the main scan direction is supported at a place separated from the pivot shaft 58*a* by a predetermined distance. Meanwhile, a solar gear 59 which is driven by the ASF motor 23 is provided such that the rotation shaft thereof is shared by the pivot shaft 58*a* and is provided so as to be engaged with the power transmission gear 53. Accordingly, the power transmission gear 53 is the planetary gear and is rotated around the solar gear 59 so as to be displaced between a first engagement position where the power transmission gear is engaged with the first transmission gear 51 and a second engagement position where the power transmission gear is engaged with the second transmission gear 52.

The lever member 58 shown in FIG. 4, which is connected to the lower end of the power switching member 55, performs a pivot operation when the power switching member 55 pivots around the pivot shaft 55*a*, and thus the power transmission gear 53 performs planetary movement.

FIGS. 4 and 5 shows the state in which the power switching member 55 is not engaged with the carriage 14. In this state, the restrained portion 55*b* of the power switching member 55 is fitted into the restraining portion 56*a* of the first restraining member 56 by the main frame 12 as the second restraining portions such that the power switching member 55 is restrained in a state the power transmission gear 53 is held at the first engagement position where the power transmission gear is engaged with the first transmission gear 51. Accordingly, in this state (in the non-engagement state of the carriage 14 and the switch holding device 40), the rear feeder 22 is driven when the power transmission gear 53 is driven in the forward rotation direction and the front feeder 25 is driven when the power transmission gear is driven in the backward rotation direction.

When the carriage 14 is moved from the state shown in FIG. 5 to the 1-digit side (the right direction of FIG. 5), the first carriage engagement portion 14*a* presses the first engaged portion 56*d* such that the movement of the first restraining member 56 to the 1-digit side together with the carriage 14 is started. Accordingly, a first restraining surface 56*b* is separated from the restrained portion 55*b* such that the restraining state of the restrained portion 55*b* by the first restraining surface 56*b* and the main frame 12 is temporarily released.

Subsequently, when the carriage 14 is further moved to the 1-digit side, a third restraining member 14*b* presses a slope surface 55*c* of the restrained portion 55*b* such that the power switching member 55 starts the pivot operation. Accordingly, the engagement between the power transmission gear 53 and the first transmission gear 51 is released and, thereafter, the power transmission gear 53 is displaced to the second engagement position where the power transmission gear 53 is engaged with the second transmission gear 52. In this state, the restrained portion 55*b* is fitted by the third restraining member 14*b* and the second restraining surface 56*c* of the restraining portion 56*a* and the power switching member 55 is restrained so as not to be pivoted again. Accordingly, in this state, when the power transmission gear 53 is driven in the forward rotation direction, the suction pump 36 of the maintenance device 33 is driven and, when the power transmission gear is driven in the backward rotation direction, the APG device 31 is driven.

Figure 6:
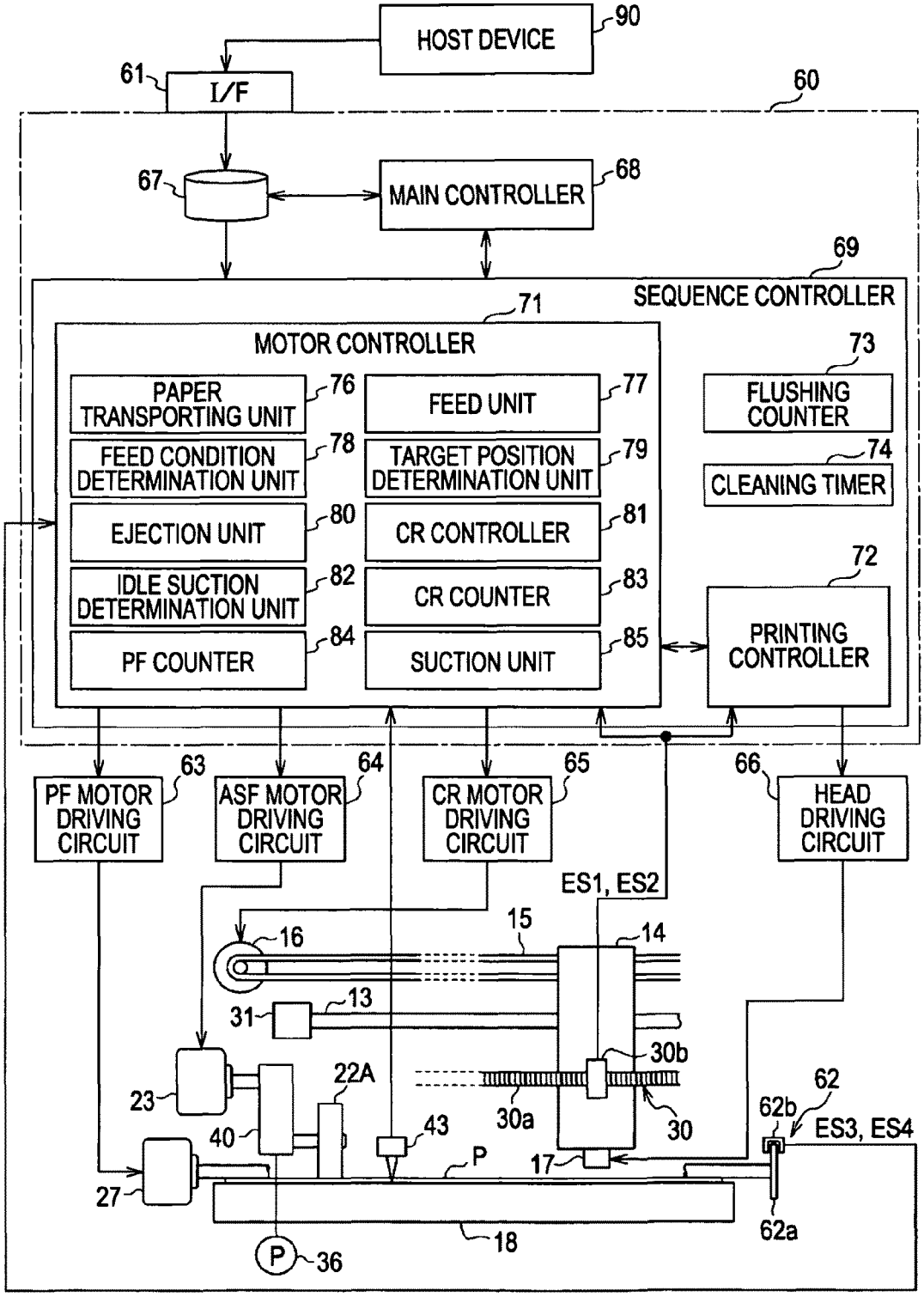
FIG. 6 is a block diagram showing the electric configuration of the printer.

FIG. 6 is a schematic block diagram showing the electric configuration of the printer 11. The printer 11 includes a controller 60, an interface (hereinafter, referred to as an I/F 61), the CR motor 16, the ASF motor 23, the PF motor 27, the linear encoder 30, the paper detection sensor 43, a rotary encoder 62, a PF motor driving circuit 63, an ASF motor driving circuit 64, a CR motor driving circuit 65, and a head driving circuit 66.

The controller 60 receives print data from a host device 90 (for example, a personal computer or the like) via the I/F 61. The controller 60 includes a buffer 67, a main controller 68 and a sequence controller 69. The main controller 68 analyzes a command of the print data received from the host device 90 via the I/F 61 and sends a variety of requests including a paper transportation request and a printing request to the sequence controller 69 according to the command. The main controller 68 sends raster data (bitmap data) other than the command of the print data to the sequence controller 69 (in more detail, a printing controller 72).

The sequence controller 69 outputs driving signals to the PF motor driving circuit 63, the ASF motor driving circuit 64, the CR motor driving circuit 65 and the head driving circuit 66 according to a predetermined sequence, in order to perform a feed operation, a printing operation, a paper transportation operation and an ejection operation on the basis of the requests received from the main controller 68. The sequence controller 69 includes a motor controller 71 for controlling the driving of the ASF motor 23 and the PF motor 27 via the motor driving circuits 63 and 64, the printing controller 72 for controlling the driving of the recording head 17 via the head driving circuit 66, and a flushing counter 73 and a cleaning timer 74 for managing the operation time of a maintenance system.

The motor controller 71 sets a start-up and running schedule (driving schedule) of the CR motor 16 or the PF motor 27, starts the transportation of the paper P while the carriage 14 is driven or the driving of the carriage 14 while the paper P is transported, and performs motor driving control including partial overlap control of the printing operation and the transportation operation in a range in which the printing is not influenced. In the present embodiment, when the printing operation of one sheet of paper P (previous paper P1) is completed, that is, when the printing operation of a final row (ink droplet ejecting operation) is completed, the feed of the subsequent paper P2 is started while the carriage 14 is moved, without waiting for the carriage 14 to be moved and stopped to a target stop position.

The printing controller 72 sets a printing schedule and controls the driving of the recording head 17. The printing controller 72 performs a variety of operations necessary for deciding an ejection time for ejecting the ink droplets from the recording head 17 and a process of deciding a printing region (a hatched region of FIGS. 7 and 8) for permitting the ejection of the ink droplets.

The motor controller 71 includes a paper transporting unit 76, a feed unit 77, a feed condition determination unit 78, a target position determination unit 79, an ejection unit 80, a carriage controller (hereinafter, referred to as a CR controller 81), an idle suction determination unit 82, a carriage counter (hereinafter, referred to as a CR counter 83), a paper transportation amount counter (hereinafter, referred to as a PF counter 84), and a suction unit 85.

The paper transporting unit 76 transports the paper P by driving the PF motor 27 via the PF motor driving circuit 63.

The feed unit 77 selectively drives the rear feeder 22 and the front feeder 25 by driving the ASF motor 23 via the ASF motor driving circuit 64. The feed is performed when the carriage 14 is in the printing region (feed region) which is the DZ position or over (80-digit side), that is, when the power transmission gear 53 is positioned at the first engagement position where the power transmission gear is engaged with the first transmission gear 51 in the switch holding device 40.

The feed condition determination unit 78 determines whether or the feed condition, in which, when the printing of the final row (final scan) of the paper which is currently being printed is completed, the transportation position of the paper (previous paper P1) reaches the position where the subsequent paper P2 can be fed, that, the previous paper P1 reaches the inter-page control position (Nx=Ng), is satisfied. If the feed condition is satisfied, since the necessary gap Lgap between the previous paper P1 and the subsequent paper P2 can be ensured, the feed operation may be started without a problem. However, if the feed condition is not satisfied, the rear end of the previous paper does not reach the position G and thus the feed cannot be started until the previous paper P1 reaches the position G.

The target position determination unit 79 determined whether the target stop position of the carriage 14 (that is, the recording head 17) for printing the final row (final scan) of the paper which is currently being printed is the printing region which is in the DZ position or over (80-digit side) or the outside the printing region (1-digit side of the DZ position). That is, it is determined whether the target stop position of the carriage 14 is the position where the power transmission gear of the switch holding device 40 is positioned at the first engagement position or the second engagement position.

The ejection unit 80 is started up when the ejection is performed, controls the driving the PF motor 27 via the PF motor driving circuit 63, and performs the ejection process of the previous paper P1 which is printed. When the feed condition determination unit 78 determines that the feed condition is not satisfied, the ejection unit 80 is started up.

The CR controller 81 controls the driving of the CR motor 16 via the CR motor driving circuit 65 at the time of printing. The CR motor 16 is driven by the CR controller 81 such that the carriage 14 is moved in the main scan direction X, and the ink droplets are ejected from the nozzles of the recording head 17 such that the printing onto the paper is performed. In addition, the movement of the carriage 14 to the flushing position at the time of flushing or the movement of the carriage to the home position at the time of idle suction, completion of the printing or cleaning is controlled.

The idle suction determination unit 82 determines whether or not an idle suction time is reached on the basis of the count value of the flushing counter 73. Here, the flushing counter 73 counts the number of times of flushing which is performed in order to the clogging of the nozzles by ejecting the ink droplets into the cap 34 of the home position side positioned at the both ends of the main scan direction during the printing operation regardless of the printing and ejecting the thickened ink in the nozzles. Although the ink droplets are ejected into the through-hole 38 positioned at the opposite side of the home position for flushing, the flushing counter 73 counts only the number of times of flushing when the ink droplets are ejected into the cap 34.

In a state in which a predetermined amount of waste ink is collected in the cap 34 due to the flushing, the waste ink collected in the cap 34 is sucked by the suction pump 36 and is discharged to the waste liquid tank 39. The predetermined amount of waste ink is determined by the number of times of flushing counted by the flushing counter 73 and this determination is performed by the idle suction determination unit 82.

The cleaning timer 74 measures an elapse time from a previous cleaning process. If the elapse time reaches a predetermined value, the cleaning of the recording head 17 is performed. The cleaning is performed by driving the suction pump 36 and applying the negative pressure to the cap 34 in a state in which the carriage 14 is positioned at the home position and the cap 34 is brought into contact with the nozzle forming surface 17*a* of the recording head 17. By the cleaning, the ink is forcedly sucked and discharged from the nozzles and air bubble or paper powder included in the ink or the thickened ink in the nozzles is eliminated.

The suction unit 85 controls the driving of the ASF motor 23 via the ASF motor driving circuit 64 at the time of idle suction or cleaning such that the suction pump 36 is driven. That is, at the time of idle suction, when the idle suction determination unit 82 determines that the idle suction time is reached, the suction unit 85 starts the forward driving of the ASF motor 23 at a capping completion timing in cooperation with the driving of the CR motor 16 for the movement of the carriage 14 to the home position by the CR controller 81, such that the suction pump 36 is driven.

The CR counter 83 counts edges of two pulse signals ES1 and ES2, of which the phases are shifted by 90 degrees, received from the linear encoder 30 at the time of the driving of the carriage. The CR counter 83 increases the count value when the carriage 14 is moved toward the 80-digit side and decreases the count value when the carriage 14 is moved to the home position (1-digit side) such that the movement position of the carriage 14 is managed using the home position as the original point.

The PF counter 84 counts the edges of pulse signals ES3 and ES4 received from the rotary encoder 62 and manages the count value according to the transportation position of the paper P. In more detail, the PF counter 84 is reset when the paper detection sensor 43 detects the front end of the paper P and, thereafter, is reset again when the front end of the paper P reaches the head reference position H (shown in FIG. 2). The count value after the reset represents the transportation position of the paper in which the front end of the paper reaches the head reference position H. This count value corresponds to Nx shown in FIG. 2. When the count value Nx is greater than the value Ng, it is determined that the feed condition that the rear end of the previous paper P1 already reaches the position G is satisfied. In addition, as shown in FIG. 6, the rotary encoder 62 includes the sign plate 62*a* fixed to the end of the shaft (the shaft of the paper transporting roller 28A) connected to the PF motor 27 such that the power can be transmitted and the sensor 62*b* for receiving the light transmitting through the slits of the sign plate 62*a* and outputting the two pulse signals ES3 and ES4 of which the phases are shifted by 90 degrees.

The feed unit 77 stops the driving of the ASF motor 23 when the count value Nx of the PF counter 84 reaches the value Ng when the previous paper P1 reaches the position G and, thereafter, the driving of the ASF motor 23 is started when the PF motor 27 is driven by the driving amount corresponding to the inter-page gap Lgap. Accordingly, the subsequent paper P2 is slowly fed by the gap Lgap while the previous paper P1 is transported.

The motor controller 71 determines the movement direction of the carriage 14 by determining whether, when the rising edge of one of the pulse signals ES1 and ES2 received from the linear encoder 30 is detected, the level of the other pulse signal is high or low. The motor controller 71 measures the pulse period of the pulse signals ES1 and ES2 and acquires the movement speed of the carriage 14 by the reciprocal thereof.

Figure 7:
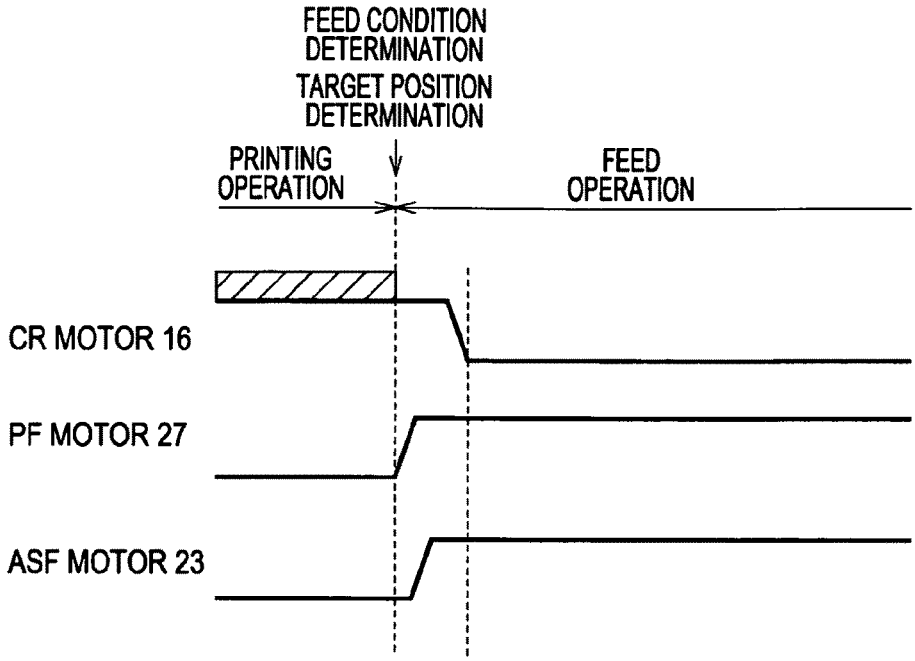
FIG. 7 is a control timing chart when a feed operation is performed after a printing operation.
Figure 8:
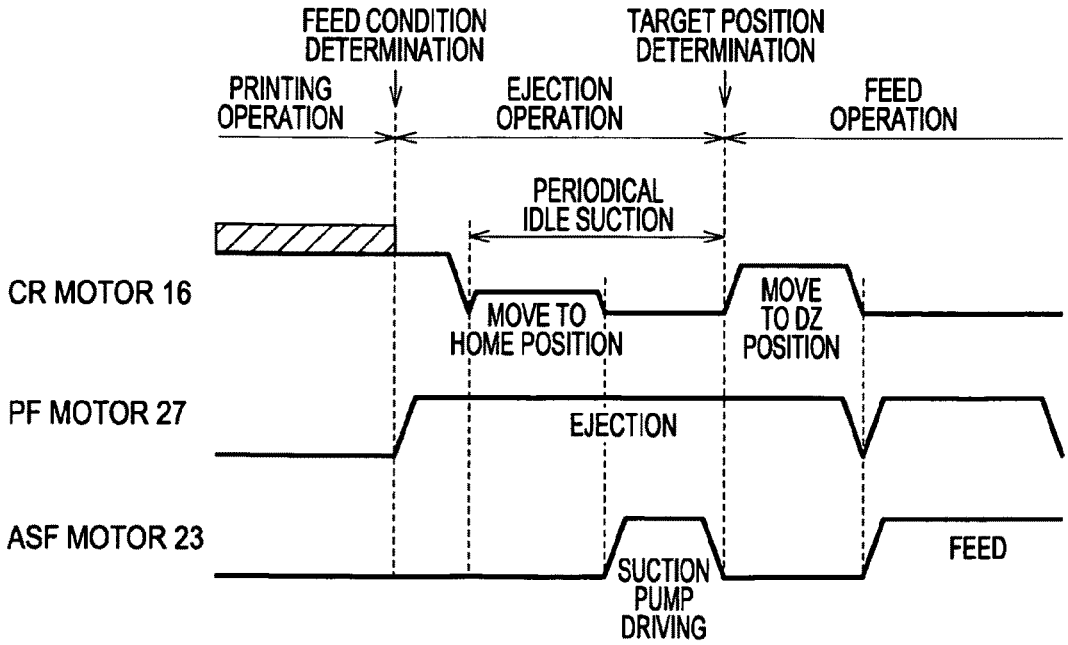
FIG. 8 is a control timing chart when an ejection operation is performed after the printing operation.

FIGS. 7 and 8 are timing charts showing the operations of the CR motor 16, the PF motor 27 and the ASF motor 23 when the printing operation of the final row is transferred to a next operation. FIG. 7 is a timing chart when the paper is already transported to the transportation position satisfying the feed condition at the time of the completion of the printing of the final row and FIG. 8 is a timing chart when the paper is not transported to the transportation position satisfying the feed condition at the time of the completion of the printing of the final row.

In FIG. 7, a hatched range represents the period (printing region) of the printing operation for ejecting the ink droplets so as to perform the printing. As shown in FIG. 7, at the time of the completion of the printing operation of the final row, the feed condition determination unit 78 determines that the feed condition is satisfied. In addition, if the target position determination unit 79 determines that the target stop position of the carriage 14 is in the printing region (including the DZ position), the feed operation is performed. That is, after the printing operation (ink droplet ejection) is completed and before the carriage 14 is stopped, the feed operation is performed and the PF motor 27 and the ASF motor 23 are driven. In FIG. 7, although the ASF motor 23 is started up slightly later than the start-up of the PF motor 27, at the time of the start of the feed operation, when the rear end of the previous paper P1 is accurately positioned at the position G (see FIG. 2) (Nx=Ng), the gap Lgap between the pages is ensured. If the Lgap is already ensured at the time of the start of the feed operation (Nx≧Ng+Lgap), the PF motor 27 and the ASF motor 23 are simultaneously driven.

Since the feed operation can be started without waiting for the carriage 14 to be stopped, the feed operation is early started such that printing throughput can be improved. For example, if the feed operation is started after the stop of the carriage 14 is waited and it is checked that the stop position is in the printing operation, the feed operation cannot be started until the carriage 14 is stopped. In contrast, in the present embodiment, since the determination is performed by the target stop position, the determination can be performed before the carriage is stopped. Accordingly, it is possible to start the feed operation while the carriage 14 is moved.

The feed condition determination determines whether or not the feed operation is performed without performing the ejection operation. If the rear end of the previous paper P1 does not reach the position G, first, the ejection process of transporting the previous paper P1 until the rear end thereof reaches the position G (Nx=Ng) is performed. The feed operation is started after the ejection process is completed. At this time, in order to ensure the inter-page gap Lgap, the ASF motor 23 is started up slightly later than the start-up of the PF motor 27.

In the target position determination, although the feed condition is satisfied, when the target stop position of the carriage 14 is the 1-digit side rather than the DZ position and the switch holding device 40 is positioned at the second switch position for selecting the APG device 31 and the suction pump 36 as the power destination of the ASF motor 23, the feeder 22 or 25 cannot be driven although the ASF motor 23 is driven. Accordingly, it is determined whether the target stop position is in the printing region in which the switch holding device 40 can be positioned at the first switch position for transmitting the power to the feeder.

As shown in FIG. 8, the printing operation is completed, although it is determined whether or not the feed condition is satisfied, if the rear end of the previous paper P1 does not reach the position G (Nx=Ng) and the feed condition is not satisfied, the previous paper P1 needs to be transported (ejected) until the rear end of the previous paper P1 reaches the position G. Accordingly, the ejection operation is performed, the PF motor 27 is started up, and the previous paper P1 is ejected until the rear end of the previous paper P1 reaches the position G (Nx=Ng). Then, after the rear end of the previous paper P1 reaches the position G, the feed operation is performed and the ASF motor 23 is started up slightly later than the start-up of the PF motor 27 in order to ensure the inter-page gap Lgap.

In the present embodiment, if the number of times of flushing from the previous idle suction, which is counted by the flushing counter 73, reaches a predetermined value, periodical idle suction is performed at the time of the ejection operation. If the ejection operation is performed, the idle suction determination unit 82 determines whether or not the periodical idle suction is performed on the basis of the number of times of flushing performed from the previous periodical idle suction obtained from the count value of the flushing counter 73. The flushing is performed in a predetermined time period in a range of 5 sec to 1 min during printing. When the flushing of the cap 34 is performed, the flushing counter 73 is increased. When both the feed condition and the target position condition are satisfied and the flushing time is reached, the carriage 14 is stopped at the target stop position of the printing region, the movement direction thereof is reversed, and the carriage is moved to the position corresponding to the through-hole 38 of the 80-digit side such that the flushing is performed with respect to the through-hole 38.

In the example of FIG. 8, after the carriage 14 is stopped at the target stop position (for example, just before the home position, such as the position in the printing region), the CR motor 16 is started up again and the carriage 14 is moved to the home position. When the power switching member 55 is pressed when the carriage 14 pass through the DZ position, the switch holding device 40 is switched to the second switch position. In this state, when the suction unit 85 drives the ASF motor 23 forward, the suction pump 36 is driven and the ink collected in the cap 34 by the negative pressure applied to the cap 34 is discharged to the waste liquid tank 39 via the suction pump 36. The flushing counter 73 is reset after the periodical idle suction is completed. When the periodical idle suction is performed, a period up to slower one of the completion of the ejection after the rear end of the previous paper P1 reaches the position G or the stop of the driving of the suction pump 36 becomes the ejection operation period.

When the ejection operation is completed (in this example, the driving of the suction pump 36 is stopped), the feed operation is performed. When the feed operation is performed, first, the target position determination unit 79 determines the target stop position. Just after the periodical idle suction is completed, the carriage 14 is positioned at the home position. During stop, the target stop position when the carriage is previously moved, that is, the current position, becomes the target stop position. In the target position determination, if the target stop position (groove position) is determined to the 1-digit side rather than the DZ position, the PF motor 27 is driven so as to move the carriage 14 to the DZ position where the switch holding device 40 can be switched to the first switch position. While the carriage 14 is moved from the home position to the DZ position, the pressing operation to the power switching member 55 by the carriage 14 is released and the switch holding device 40 is switched to the first switch position by the restoration force of the coil spring 57. When the carriage 14 reaches the DZ position, the switch holding device 40 drives both the ASF motor 23 and the PF motor 27 at the first switch position such that the ejection of the previous paper P1 and the feed of the subsequent paper P2 are performed.

In the example of FIG. 8, the ejection of the previous paper P1 which is started when the ejection operation is performed is continuously performed until the carriage 14 reaches the DZ position although the feed operation is performed when the ejection is not completed. In contrast, the driving of the PF motor 27 may pause according to the start of the feed operation (the stop of the driving of the pump) and the PF motor 27 may be driven again at the time of the start of the feed operation such that the remaining ejection is performed.

After the previous paper P1 is ejected, in order to enable the head of the fed subsequent paper P2 to appear (transport the subsequent paper to the print start position), the PF motor 27 is continuously driven. In FIG. 8, in a state in which the carriage 14 reaches the DZ position, the rear end of the previous paper P1 reaches the position G and the driving of the PF motor 27 is stopped. In this case, since the inter-page gap Lgap is already ensured, the PF motor 27 and the ASF motor 23 are simultaneously driven.

Figure 9:
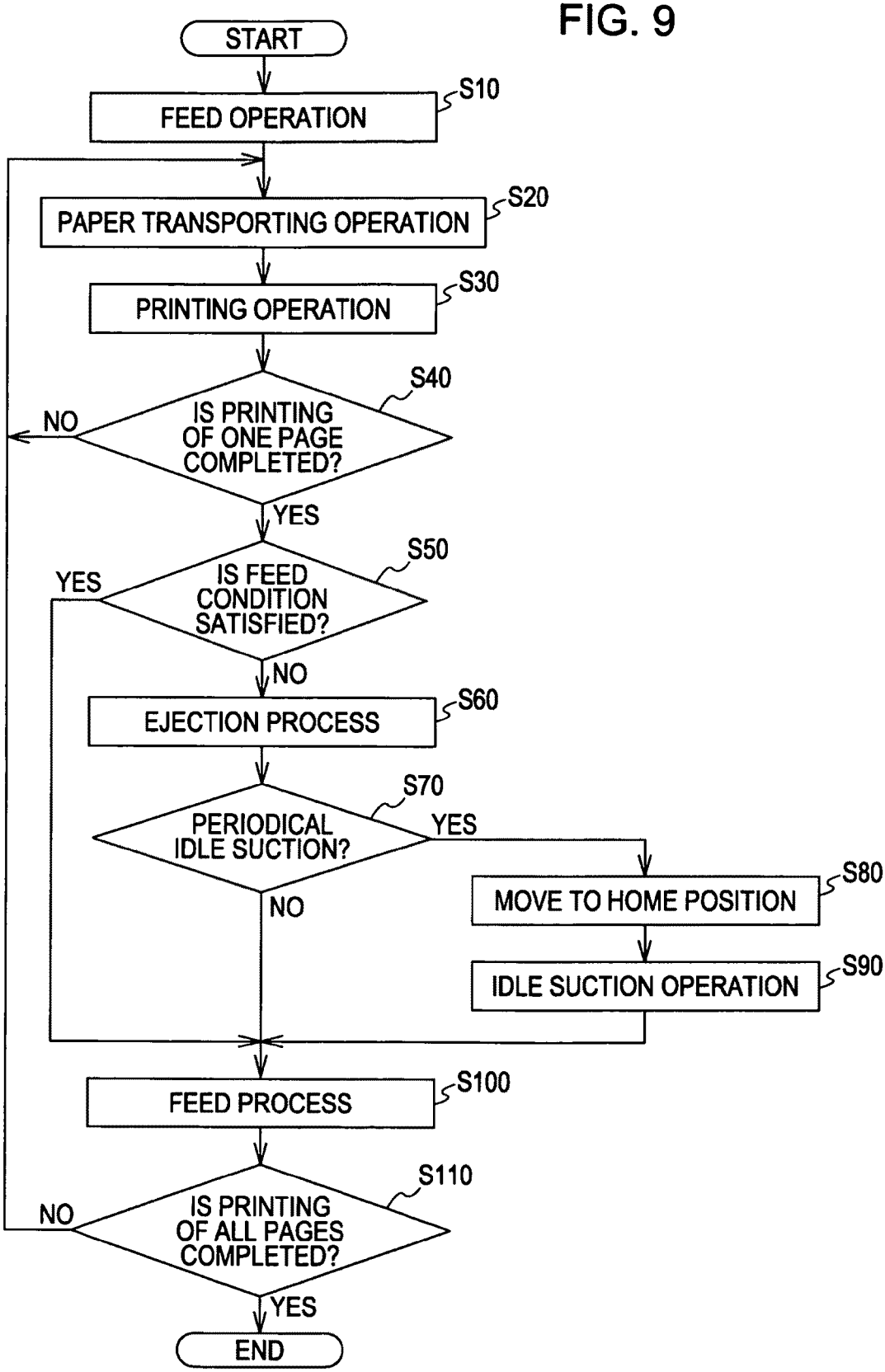
FIG. 9 is a flowchart showing a printing process.

FIG. 9 is a flowchart showing a printing process performed by the sequence controller 69 on the basis of the instruction of the main controller 68. Hereinafter, the printing process will be described with reference to FIG. 9.

For example, when print data is received from the host device 90, the main controller 68 sends the instruction for starting the printing process to the sequence controller 69 on the basis of the print data. The sequence controller 69 performs the feed operation for feeding first paper P (S10). That is, the feed unit 77 drives the ASF motor 23 and feeds the paper by any one of the feeders 22 or 25.

Next, the PF motor 27 is driven and the fed paper P is transported (S20). The transportation of the first paper after the feed is the heading of the paper P. When the count value according to the heading amount from the position where the paper detection sensor 43 detects the front end of the paper P is obtained by the PF counter 84, the driving of the PF motor 27 is stopped.

In a step S40, it is determined whether printing of one page is completed. If the printing is not completed, the process returns to the step S20, the transportation of the paper of the step S20 and the printing of the step S30 are repeated such that the printing is performed one row by one row.

If the printing of one page is completed (Yes in S40), in a next step S50, it is determined whether the feed condition is satisfied. If the feed condition is not satisfied, the ejection process is performed (step S60) and, if the feed condition is satisfied, the feed process is performed (step S100).

In the case where the ejection process is performed, the PF motor 27 is driven and the previous paper P1 is ejected (S60). Then, in a step S70, it is determined whether or not the periodical idle suction is performed. That is, if the number of times of flushing from the previous idle suction is equal to or greater than the predetermined value on the basis of the count value of the flushing counter 73, the idle suction determination unit 82 determines that the periodical idle suction should be performed. If yes in the step S70, the CR controller 81 drives the CR motor 16 so as to move the carriage 14 to the home position. In contrast, if no, the feed process is performed (S100).

The carriage 14 which moves to the home position presses the power switching member 55 of the switch holding device 40 when passing through the DZ position so as to switch the power switching member 55 to the first switch position. After the carriage 14 is moved to the home position, the idle suction operation is performed (S90). That is, the ASF motor 23 is driven forward, the suction pump 36 is driven, and the waste ink in the cap 34 is sucked and eliminated. If the periodical idle suction is completed, the feed process is performed.

Figure 10:
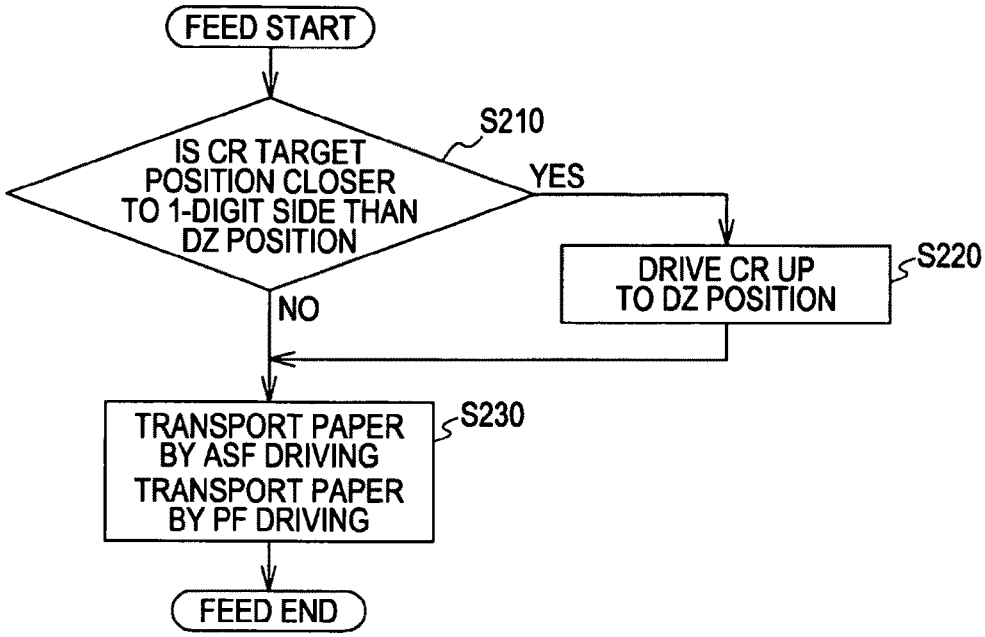
FIG. 10 is a flowchart showing a feed process.

In the feed process of the step S100, the feed unit 77 performs a feed processing routine shown in FIG. 10. First, in a step S210, it is determined whether the target stop position of the carriage 14 is the 1-digit side rather than the DZ position. If it is determined that the target stop position of the carriage is the 1-digit side rather than the DZ position, the process progresses to the step S220 and the carriage 14 is moved to the DZ position. In FIG. 8, this process corresponds to a process of performing the feed operation after the periodical idle suction so as to move the carriage 14 from the home position to the DZ position. In contrast, if it is determined that the target stop position of the carriage is not the 1-digit side rather than the DZ position, that is, the target stop position of the carriage is in the printing region, the process progresses to a step S230, in which the ASF motor 23 is driven so as to be fed the paper P and the PF motor 27 is driven so as to transport the paper P. In this case, if the previous paper P1 is not ejected, the subsequent paper P2 is fed and the previous paper P1 is ejected by the driving of the PF motor 27. If the previous paper P1 is already ejected, the subsequent paper P2 fed by the driving of the ASF motor 23 is nipped and transported by the paper transporting roller 28 by driving the PF motor 27.

As described above, according to the first embodiment, the following effect can be obtained.

(1) When the printing operation of the final row is completed (the printing of one page is completed), it is determined whether the feed condition is satisfied. If the feed condition is satisfied, the feed is immediately started. Accordingly, the feed of the subsequent paper P2 can be started before the carriage 14 is stopped.

(2) If the feed condition is satisfied, the target stop position of the carriage 14 is examined and, if the target stop position is in the printing region (≧DZ), that is, the carriage position where the switch holding device 40 is positioned at the switch position where the power destination of the ASF motor 23 is the feeders 22 and 25, it is determined that the feed can be continuously performed even after the carriage is stopped when the ASF motor 23 is driven. Accordingly, when it is determined that the switch holding device 40 is switched to the first switch position (feed position) when the carriage is stopped, the feed operation can be previously started before the carriage is stopped.

(3) If the feed condition is satisfied and the target stop position is satisfied, the feed operation is performed. Accordingly, a time when the feed can be performed is appropriately determined and thus the feed operation can be previously started before the carriage is stopped.

(4) After the idle suction is completed in the ejection operation, the target stop position (that is, the current position which is the target stop position when the carriage is previously moved) of the carriage 14 during stop is examined and the carriage 14 is moved from the home position to the DZ position using the target stop position (current position) as the home position. Accordingly, the movement to the DZ position which is the position for performing a next feed process after the idle suction can be performed by checking the target stop position.

(5) The switch holding device 40 is in the switch state to the first switch position (feed position) for transmitting the power to the feeders 22 and 25 by the energization of the coil spring 57 when the carriage 14 is positioned at the position where the power switch member 55 is not operated (that is, the position in the printing region). Accordingly, if the position where the carriage 14 stops the movement for the recording of the final row is in the printing region, the feed operation can be previously started without waiting for the carriage 14 to be stopped.

(6) Since the idle suction is performed only during the ejection operation, for example, when the feed can be started immediately after the printing operation of the final row is completed, the feed operation is prior to the idle suction and thus the printing throughput can be improved. For example, if the idle suction is necessarily performed when the idle suction condition that the count value of the flushing counter 73 is equal to or greater than the predetermined value is satisfied, the feed operation is delayed by the time consumed for the idle suction operation and the printing throughput deteriorates. However, according to the present embodiment, it is possible to avoid the delay of the start of the feed operation when the idle suction condition is satisfied.

Second Embodiment

The present embodiment will be described according to the timing chart shown in FIG. 11. While the stop position of the carriage 14 after the printing operation of the final row is completed is in the printing region in the first embodiment, when the periodical idle suction should be performed after the printing operation of the final row, the target stop position of the carriage 14 at the time of the printing operation of the final row is set to the home position in the second embodiment. Accordingly, after the printing operation of the final row is completed, the carriage 14 is moved to the home position and is stopped.

Figure 11:
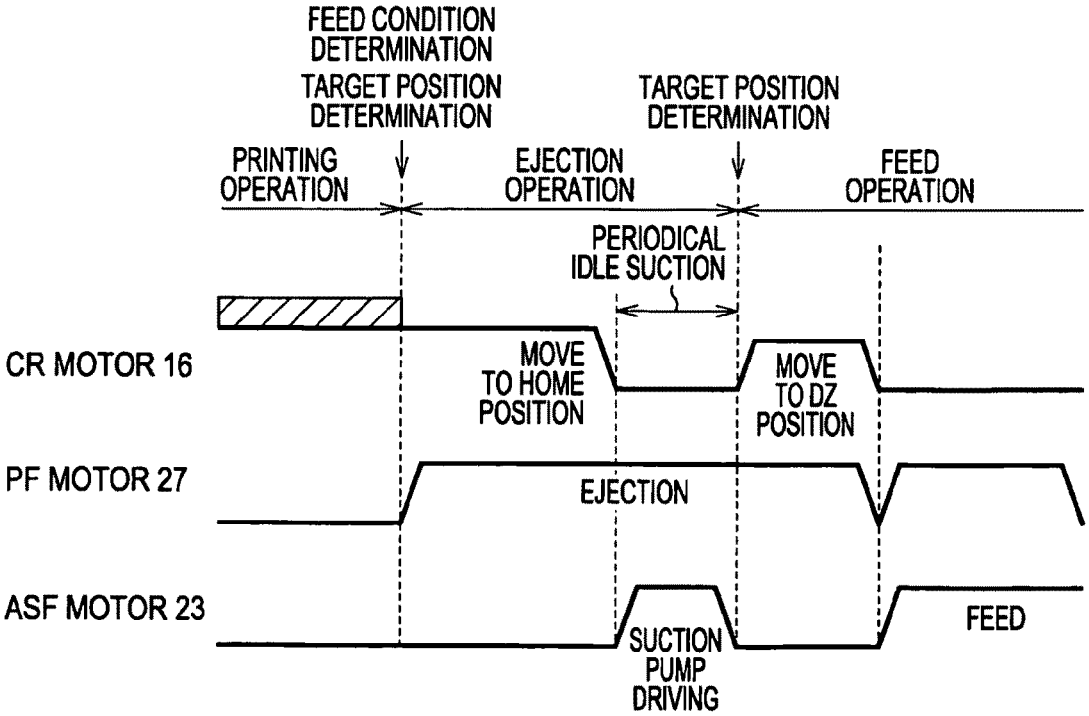
FIG. 11 is a control timing chart when an ejection operation is performed after a printing operation in a second embodiment of the invention.

As shown in FIG. 11, when the printing operation of the final row is completed, the feed condition determination is performed and the target position determination is then is performed if the feed condition is satisfied. Since the target stop position is set to the home position (that is, the carriage position where the switch holding device 40 is positioned at the second switch position where the feeders 22 and 25 are not selected as the power destination of the ASF motor 23, even the feed condition is satisfied, the ejection process is performed. If the feed condition is satisfied and it is determined that the target stop position is in the printing region, the feed operation is performed.

According to the second embodiment, the following effect can be obtained.

(7) Since the target stop position at the time of the printing operation of the final row is the home position when the periodical idle suction is performed, after the printing operation of the final row is completed, the carriage 14 can be moved to the home position HP where the idle suction should be performed without stop. Accordingly, the idle suction can be early started. For example, even when the ejection of the previous paper P1 is completed later than the idle suction, the idle suction is early started and thus is early completed, the feed of the subsequent paper P2 can be early started.

(8) After the printing operation of the final row is completed, the target stop position of the carriage 14 is examined and it is determined whether the ejection operation or the feed operation is performed before the target stop position is reached. Accordingly, after the printing operation of the final row is completed, if it is determined that the feed operation is performed from the target stop position, the feed operation can be early started before the carriage 14 is stopped. As a result, the feed operation can be early started, compared with the operation for determining whether the stop position checked after the carriage 14 is stopped is the position where the feed is possible and starting the feed operation.

The embodiment is not limited to the above-described embodiments and may be modified as follows.

Modified Example 1

Although the feed condition determination is performed and the target position determination is then performed only when the feed condition is satisfied in the first embodiment, the configuration that the target position determination is first performed and the feed condition determination is performed only when the target position condition is satisfied may be employed.

Modified Example 2

The switch holding device 40 is not necessary as the switch unit. For example, the configuration that the maintenance device 33 is driven by an electric motor (power source) different from the ASF motor 23 (power source) of the feed device may be employed. Even by this configuration, when both the feed condition and the target position condition are satisfied, the feed operation can be early performed. In the case where any one of the both conditions is not satisfied, the idle suction can be performed when the ejection is performed and when the operation time of the time management unit is reached. Accordingly, the same effects as the first embodiment and the second embodiment can be obtained.

Modified Example 3

Even when the feed condition is satisfied, if the idle suction operation time is reached, the configuration that the idle suction is prior to the feed may be employed. In this case, although the feed condition is satisfied, if the idle suction determination unit 82 determines that the idle suction operation time is reached, the CR controller 81 drives the CR motor 16 such that the carriage 14 is moved to the home position.

Modified Example 4

In the embodiments and the modified examples 2 and 3, the flushing may be performed by the idle suction. By this configuration, when the feed condition is satisfied and the target position condition is satisfied, the feed operation can be started immediately after the printing operation is completed. When the ejection needs to be performed because at least one of the conditions is not satisfied, the flushing for discharging the ink droplets into the cap 34 at the home position can be performed.

Modified Example 5

In the above-described embodiments, the power destination of the power source is selected from the two feeders, the maintenance device (suction pump) and the platen gap adjustment device (APG device) by the switch holding device (switch unit). Although another unit includes two units including the maintenance device and the APG device, only any one of the maintenance device and the APG device may be included. If another unit is the maintenance device, the same effect as the above-described embodiments can be obtained. If another unit is the APG device, at the time of switching the previous paper to the subsequent paper, the target stop position is set to the inside of the recording region when the thickness of the paper is not changed and the target stop position is set to the home position when the thickness of the paper is changed. After the carriage 14 is stopped at the home position, the ASF motor 23 is driven backward and the platen gap is adjusted.

Modified Example 6

In a printing process (recording process) which satisfies the feed condition at the time of the completion of the printing of one page (completion of the printing operation of the final row), such as photographic printing or marginless printing, only the target position determination may be performed without performing the feed condition.

Modified Example 7

The feed condition determination or the target position determination is not performed only after the printing operation of the final row is completed. It is not limited if the feed operation which should be started after the determination can be performed after the printing operation of the final row is completed and before the carriage is stopped. For example, the determination timing may be before the printing operation of the final row is started, during the printing of the final row, or during the deceleration of the carriage after the printing of the final row is completed.

Modified Example 8

The serial recording apparatus is not limited to the ink jet printer. It is applicable to a dot impact printer or a thermal transfer printer.

Modified Example 9

A fluid ejection type serial recording apparatus is not limited to the ink jet printer. A fluid ejecting apparatus for ejecting or discharging other fluid (including liquid, liquid in which particles of a functional material is dispersed or mixed, fluid such as gel, solid which can be ejected as fluid (for example, powder including a toner) other than ink may be implemented. For example, a liquid ejecting apparatus for ejecting liquid, in which a material such as an electrode material or a color material (pixel material) is dispersed or melted, used for manufacturing a liquid crystal display, an electroluminescence (EL) display and a surface emission display, a liquid ejecting apparatus for ejecting transparent resin liquid such as ultraviolet curing resin onto a substrate in order to form a minute semispherical lens (optical lens) used in an optical communication device, a liquid ejecting apparatus for ejecting etching liquid such as acid or alkali in order to etch a substrate, and a fluid ejecting apparatus for ejecting fluid such as gel (for example, physical gel) may be implemented. The recording for forming a predetermined pattern (including a wiring pattern, an electrode pattern, a pixel pattern, an etching pattern and an arrangement pattern) formed by impacting the ejected fluid on to a recording medium such as a substrate is included in the recording of the recording apparatus in the present specification. The fluid does not include fluid including only gas and includes, for example, liquid (including inorganic solvent, organic solvent, solution, liquid resin, or liquid metal (metal melt)), powder and fluid.

What is claimed is:

1. A serial recording apparatus comprising:

a feed unit which feeds a recording medium;

a recording unit which performs recording with respect to the fed recording medium;

a movement unit which moves the recording unit;

a transporting unit which transports the recording medium in a direction crossing the movement direction of the recording unit;

a controller which controls the recording unit, the movement unit, the transporting unit and the feed unit; and a determination unit which determines whether a target stop position of the recording unit satisfies a target position condition and whether a transportation position of a preceding recording medium satisfies a feed condition in which the subsequent recording medium can be fed, during the movement of the recording unit, wherein the controller starts a feed operation of the subsequent medium using the feed unit at a timing before the movement of the recording unit is stopped, if both of the target position condition and the feed condition are satisfied, wherein the controller doesn't start the feed operation of the subsequent medium, if either the target position condition or the feed condition is not satisfied.

2. The serial recording apparatus according to claim 1, wherein:

a power source of the feed unit is shared by other driven units, a switching unit which switches a power destination of the power source at a switch position according to the movement position of the recording unit is further included, and the determination unit determines that the target position condition is satisfied if the target stop position of the recording unit is a position where the feed unit is selected as the power destination.

3. The serial recording apparatus according to claim 2, wherein the feed unit is selected as the power destination of the power source if the target stop position of the recording unit is in a recording region and the other driven units are selected as the power destination of the power source if the target stop position of the recording unit is outside the recording region of a home position side from the recording region.

4. The serial recording apparatus according to claim 3, further comprising:

a maintenance unit which is driven when maintenance for ejecting liquid from the recording unit and shares the power source with the feed unit, a management unit which manages a time for performing the maintenance, and if the time is reached and the target stop position is outside the recording region, the controller performs the maintenance.

5. A method of feeding a recording medium, in which a subsequent recording medium is fed when recording using a recording unit of a preceding recording medium is completed, the method comprising:

determining whether a target stop position of the recording satisfies a target position condition during the movement of the recording unit, determining whether a transporting position of a preceding recording medium satisfies a feed condition in which the subsequent recording medium can be fed, during the movement of the recording unit, starting a feed operation of the subsequent recording medium using a feed unit at a timing before the movement of the recording unit is stopped, if both of the target position condition and the feed condition are satisfied, and performing an ejection process of the preceding recording medium earlier than the feed of the subsequent recording medium if either the target position condition or the feed condition is not satisfied.

* * * * *